US006924731B2

(12) United States Patent
Fallon et al.

(10) Patent No.: US 6,924,731 B2
(45) Date of Patent: Aug. 2, 2005

(54) POWER SUPPLY ALARM CONTROL SYSTEM

(75) Inventors: Raymond M. Fallon, Galway (IE); Jane E. Morgan, Narragansett, RI (US); Thomas N. Fegan, Galway (IE); Jacqueline M. Hayes, Galway (IE); Edward M. Ives, West Kingston, RI (US)

(73) Assignee: American Power Conversion Corporation, West Kingston, RI (US)

( * ) Notice: Subject to any disclaimer, the term of this patent is extended or adjusted under 35 U.S.C. 154(b) by 64 days.

(21) Appl. No.: 10/016,732

(22) Filed: Dec. 11, 2001

(65) Prior Publication Data

US 2003/0107494 A1 Jun. 12, 2003

(51) Int. Cl.[7] ..... G08B 1/00

(52) U.S. Cl. ..... 340/309.16; 340/310.01; 340/506; 307/64; 700/14; 700/16; 700/297; 713/300; 713/340; 714/22

(58) Field of Search ..... 340/506, 539.1, 340/309.15, 573.1, 309.16, 636.1, 636.15, 310.01; 713/300, 340, 320; 700/293, 297, 298, 295, 14, 16; 714/14, 22; 307/64, 66; 702/63

(56) References Cited

U.S. PATENT DOCUMENTS

| | | | | | |
|---|---|---|---|---|---|
| 5,315,533 | A | * | 5/1994 | Stich et al. | 364/480 |
| 5,958,054 | A | * | 9/1999 | O'Connor et al. | 713/300 |
| 6,229,450 | B1 | * | 5/2001 | Malmsten | 340/652 |
| 6,255,744 | B1 | * | 7/2001 | Shih et al. | 307/66 |
| 6,583,720 | B1 | * | 6/2003 | Quigley | 340/521 |

* cited by examiner

*Primary Examiner*—Davetta W. Goins
(74) *Attorney, Agent, or Firm*—Mintz, Levin, Conn, Ferris, Glovsky and Popeo, P.C.

(57) ABSTRACT

Methods and systems are provided for controlling the enabling and/or disabling of an audio alarm that indicates an occurrence of a predetermined event of a power supply, such as an uninterruptible power supply (UPS). In one embodiment of the invention, the method includes programming the UPS to enable the audio alarm of the power supply during a first predetermined time period, and programming the UPS to disable the audio alarm of the power supply while the power supply is still operational during a second predetermined time period. In embodiments of the invention, the system is able to enable and disable an audio alarm during specified time periods of the day. Thus, a user can use the system to designate when an alarm will not sound so as not to disturb the user or others at an inconvenient time.

30 Claims, 3 Drawing Sheets

POWER SUPPLY ALARM CONTROL SYSTEM

FIELD OF THE INVENTION

The present invention relates generally to power supply systems. More specifically, embodiments of the present invention are directed to systems and methods that control an alarm for uninterruptible power supply (UPS) systems.

BACKGROUND OF THE INVENTION

The use of UPS's having battery back-up systems to provide regulated, uninterrupted power for critical and/or sensitive loads, such as computer systems, and other data processing systems is well known. A UPS system can have an audio alarm to provide a user with notification of an occurrence of one or more predetermined power related issues, such as a low or bad UPS battery. For example, a UPS can sound an alarm to notify a user that a UPS battery has a low or insufficient voltage. However, in some circumstances it may be necessary or desirable to have flexible control of the enabling and disabling of the audio alarm.

Although some UPS devices provide dip-switches to allow a user to manually turn-off the alarm, it can be bothersome to manually turn the alarm on and off on a daily or frequent basis.

One device, PowerChute Personal Edition, manufactured by the American Power Conversion of W. Kingston, R.I., provides to a user an audio notification of a UPS failure. However, PowerChute doesn't allow a user to flexibly control the alarm other than to enable, disable or mute the alarm.

SUMMARY OF THE INVENTION

Embodiments of the invention provide methods of controlling the enabling and/or disabling of an audio alarm that indicates an occurrence of a predetermined event of a power supply. In one embodiment of the invention, a method includes programming to enable the audio alarm of the power supply during a first predetermined time period, and programming to disable the audio alarm of the power supply while the power supply is still operational during a second predetermined time period.

In another embodiment, a system for controlling an audio alarm indicates an occurrence of a predetermined event of an uninterruptible power supply (UPS). The system in this embodiment includes means for programming to enable the audio alarm of the UPS during a first predetermined time period, and means for programming to disable through software the audio alarm of the UPS while the UPS is still operational during a second predetermined time period.

In yet another embodiment, a system for controlling an audio alarm indicates an occurrence of a predetermined event of a power supply. In this embodiment, the system includes a power supply having an alarm, and a computer system coupled to the power supply and programmed to: enable the audio alarm of the power supply during a first predetermined time period; and disable the audio alarm of the power supply during a second predetermined time period.

In still yet another embodiment, an article of manufacture includes a computer usable medium having computer readable program code embodied therein for controlling an audio alarm that indicates an occurrence of a predetermined event of a power supply coupled to a computer system, wherein the computer readable program code includes: instructions for causing the computer system to enable the audio alarm of the power supply during a first predetermined time period; and instructions for causing the computer system to disable the audio alarm of the power supply while the power supply is still operational during a second predetermined time period.

One advantage of embodiments of the invention is that the system is able to automatically enable and disable an audio alarm during specified time periods of the day. Thus, a user can designate when an alarm will and will not sound so as not to disturb the user or others at an inconvenient time.

BRIEF DESCRIPTION OF THE DRAWINGS

For a better understanding of the present invention, reference is made to the drawings which are incorporated herein by reference and in which.

DETAILED DESCRIPTION OF THE INVENTION

Figure 1:
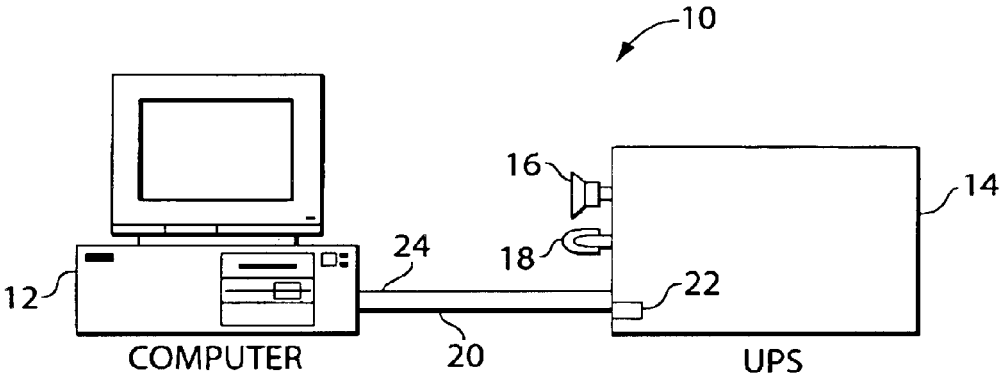
FIG. 1 is a block diagram of the power supply critical state monitoring system according to the present invention.

A first embodiment of a system 10 of the present invention will now be described with reference to FIG. 1. The system 10 includes a computer 12 is coupled to a power supply, such as an uninterruptible power supply (UPS) 14. The UPS 14 has an audible alarm 16 and can have a visual indicator 18, such as a light emitting diode (LED). The UPS 14 is coupled to the computer 12 through a communication cable 20 and a power cable 24. The UPS 14 can have a computer interface card 22 for communicating with the computer 12 over cable 20. The computer 12 can have a card or interface in it for communicating with the UPS 14 over cable 20. The UPS 14 typically provides the computer 12 with power over line 24 and will continue to do so if the main power source of the computer is interrupted.

The audio alarm 16 of the UPS 14 is configured to sound if one or more predetermined events occur to the UPS or main power supply of the computer. The predetermined events can include, for example, the computer losing its main power source, a specified age of the UPS 14, a power supply or a battery contained in the UPS, a predetermined remaining runtime of a battery, a failure of the UPS, a power supply or a battery's failure to pass a self diagnostic test, the UPS or power supply being unavailable or the load of the UPS being greater than a predetermined limit.

In one embodiment, the computer including one or more software programs for controlling the audio alarm 16 of the UPS 14, and in addition, firmware is provided in the UPS 14 to enable, disable or mute the audio alarm 16 of the UPS. To control the audio alarm 16, the software program communicates with and controls the firmware of the UPS 14 to enable, disable or mute its audio alarm.

The computer software can have one or more threshold values for a predetermined event if necessary, such as the age or the remaining runtime of a battery. The obtained threshold values are preferably set as default values in the computer software and are changeable such that the default threshold values are user definable. A threshold level may not be necessary for some events, such as for the failure of a battery.

Embodiments of the invention allow a user to automatically enable or disable the audio alarm 16 of the UPS 14 during one or more predetermined time periods. Thus, a user can disable the audio alarm to prevent the alarm from disturbing one or more people. This can be desirable for times such as during the evening when the user is sleeping or during the day if the user does not want to be disturbed.

The UPS 14 can also include a visual indicator 18, such as an LED or a light, to provide an indication that the predetermined event has occurred. The visual indicator can be activated to indicate an event when the audio alarm is disabled or enabled. The visual indicator 18 can be mounted on the UPS or can be provided external to the UPS such as mounted on or near the computer. The visual indicator can turn on or blink during the occurrence of a predetermined event.

In another embodiment of the invention, the system 10 can be configured for the use of two or more different users. A first user can specify that the UPS audio alarm 16 is to be disabled during one or more time periods and the second user can specify one or more different time periods that the audio alarm is disabled. Thus, the system 10 can be configured such that the times the audio alarm 16 is enabled or disabled are flexible according to the desires of one or more users.

Figure 2:
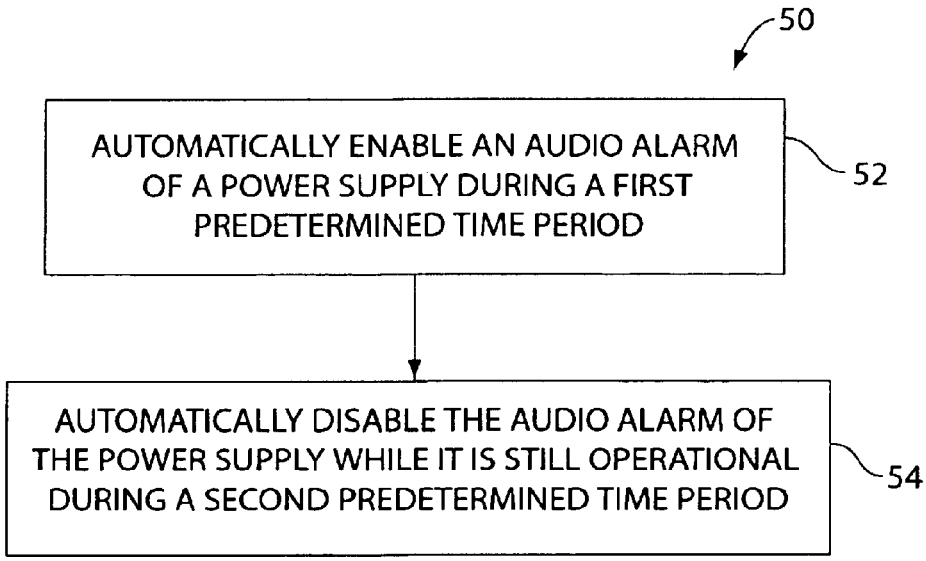
FIG. 2 is a flowchart of an exemplary method of monitoring a power supply according to the present invention.

FIG. 2 shows a method 50 of controlling an audio alarm 16 for indicating an occurrence of a predetermined event of a power supply, such as a UPS 14, coupled to a computer. At 52, the audio alarm 16 of the power supply is automatically enabled during a first predetermined time period. During this first time period, if one of the predetermined events that would normally sound the alarm occurs, then the alarm will sound as usual to tell a user that the event has occurred. At 54, the audio alarm 16 of the power supply is automatically disabled while the power supply is still operational during a second predetermined time period. During this second time period, if one of the predetermined events occurs, the UPS 14 will not sound the audio alarm and potentially disturb someone. The user can specify the second time period that the alarm 16 is disabled through computer software. The first and second time periods when added together can equal one day, or longer time period such as a week or a shorter time period such as a workday. Additionally, the alarm 16 can be enabled and disabled several times throughout a time period such as a day.

Figure 3:
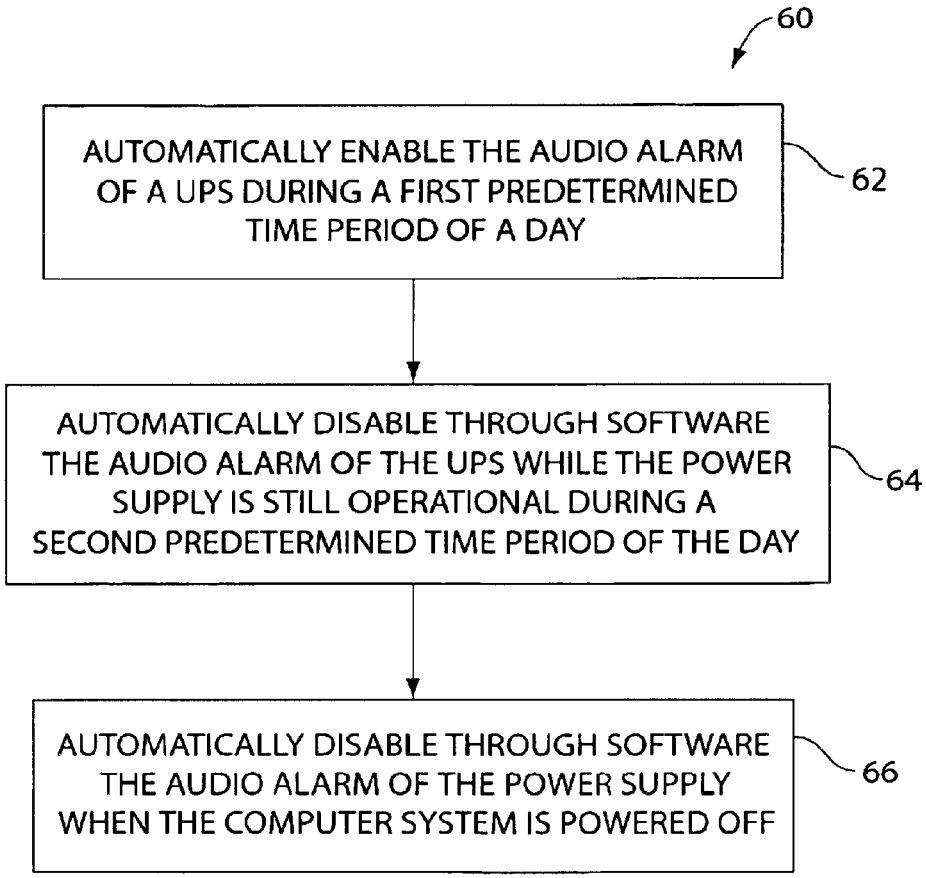
FIG. 3 is a flowchart of an exemplary method of monitoring a power supply once it is determined that the power supply has lost communication with a computer network.

FIG. 3 shows a method 60 of controlling an audio alarm 16 for indicating an occurrence of a predetermined event of an uninterruptible power supply 14 (UPS) coupled to a computer. At 62, the audio alarm 16 of the UPS 14 is automatically enabled during a first predetermined time period of a day. At 64, the audio alarm 16 of the UPS 14 is automatically disabled through software while the UPS is still operational during a second predetermined time period of the day. At 66, the audio alarm 16 of the UPS 14 is automatically disabled through software when the computer system is powered off. Because, the computer software disables the alarm in the method 60, it is preferable that the UPS audio alarm 16 is disabled when the software program is shut down so as not to disturb a user during an undesirable time if a predetermined event occurs.

It should be noted with the methods 50 and 60 that the UPS 14 may have the audio alarm 16 typically enabled and a software program automatically disables the alarm or that the UPS may have the audio alarm typically disabled and a software program automatically enables the alarm.

Figure 4:
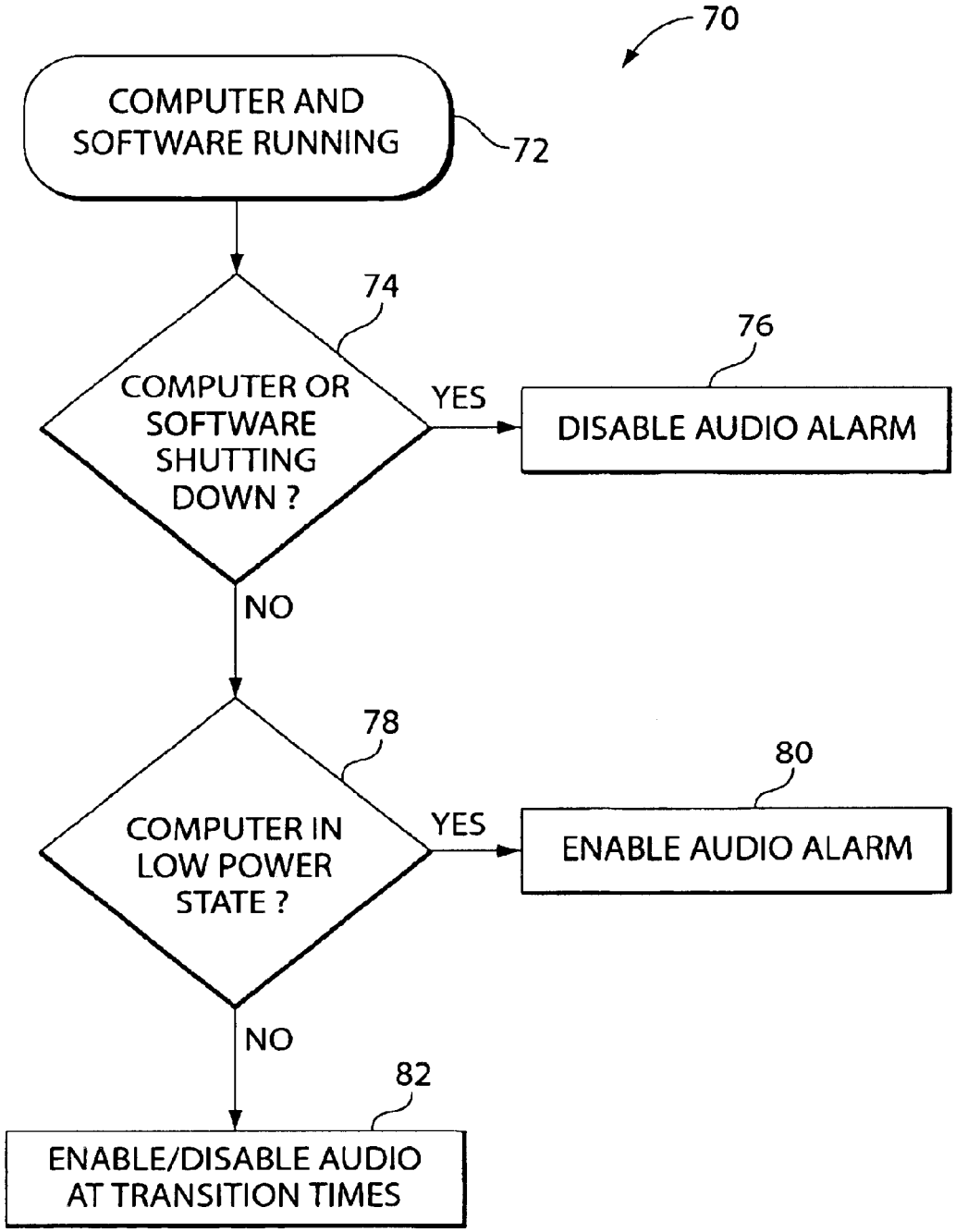

FIG. 4 shows another method 70 of controlling an audio alarm 16 for indicating an occurrence of a predetermined event of an uninterruptible power supply (UPS) coupled to a computer. The method begins at 72 with the computer running and UPS software program installed and running on the computer 12. At 74, the computer 12 determines if either it or the UPS software program is shutting down. If either the computer 12 or the UPS software program is shutting down, then the UPS audio alarm is disabled so that the alarm will not go off unexpectedly. If both the computer 12 and UPS software program are running, at 78 the UPS program determines if the computer is in a low power state. If the computer 12 is in a low power state, then at 80 the audio alarm 16 is enabled. If the computer is not in a low power state, then at 82 the audio alarm is enabled and disabled as programmed in the UPS software program.

Software used with embodiments of the present invention can be stored on any type of a computer usable medium for storing data, such as, for example, but not limited to, floppy disks, magnetic tape, zip disks, hard drives, CD-ROM, optical disks, or a combination of these. It should be understood that although the description above has described embodiments of the invention as having a single program, the program can easily be separated into more than one program and still be within the scope of the invention. Also, the methods of the programs can be completed either through software, firmware or hardware.

Rather than or in additional using computer software to disable the UPS audio alarm, the UPS can have a programmable interface on it such that a user can program the time periods during which the UPS audio alarm will be enabled and/or disabled.

Additionally or alternatively, the UPS 14 can be connected to a computer network and send an e-mail to one or more predetermined people to notify them of a predetermined event if the audio alarm is disabled. Such as system is disclosed in the application entitled Power Supply Event Notification System, which was filed with the U.S. Pat. and Trademark Office on Mar. 20, 2001, has Ser. No. 09/812,665 and is hereby incorporated by reference.

An advantage of embodiments of the present invention is when a UPS is used to provide backup power to a home computer system, the UPS can be programmed such that the audio alarm will not sound in the middle of the night. Another advantage of embodiments of the invention is that when a UPS is used in a noise sensitive work environment, such as a meeting room, the UPS can be programmed such that the alarm will not sound during a meeting.

It should be also understood that although the description above has described embodiments of the invention as used with a UPS 14, the invention is also applicable to other types of power supplies and other devices that are operated using batteries.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A method of controlling an audible alarm of a backup power supply that indicates an occurrence of an event, the backup power supply being operatively coupled to and separate from a computer, the method comprising:

programming the backup power supply through computer software operating on the computer to enable the audible alarm on the backup power supply during at least a first predetermined time period in response to detection of the occurrence of an event; and programming the backup power supply through the computer software to disable the audible alarm on the backup power supply while the backup power supply is operational during at least a second predetermined time period in response to detection of the occurrence of an event.

2. The method of claim 1, wherein programming the backup power supply through the computer software to enable the audible alarm includes using the computer software to enable the audible alarm through firmware of the backup power supply.

3. The method of claim 1, wherein programming the backup power supply through the computer software to disable the audible alarm includes using the computer software to disable the audible alarm through firmware of the backup power supply.

4. The method of claim 1, wherein the event includes a condition of at least one of the computer, the backup power supply and a main power supply operatively coupled to the computer.

5. The method of claim 1, wherein the event includes the backup power supply providing power to the computer.

6. The method of claim 1, further comprising designating through the computer software at least one value that indicates, upon detection of the value, the occurrence of the event.

7. The method of claim 6, wherein the at least one value includes a user-definable value that can be modified by programming through the computer software.

8. The method of claim 1, further comprising programming the backup power supply through the computer software to disable the audible alarm when at least one of the computer software is not operating and the computer is powered off.

9. The method of claim 1, further comprising programming the computer through the computer software to determine whether the computer is in a low power state and further comprising programming the backup power supply through the computer software to enable the audible alarm automatically when the computer enters a low power state.

10. The method of claim 1, further comprising programming the computer through the computer software to determine whether the computer enters a low power state and further comprising programming the backup power supply through the computer software to enable the audible alarm during the first and the second predetermined periods if the computer is in a low power state.

11. The method of claim 1, further comprising providing a visual indicator operatively coupled to one of the computer and the backup power supply, and activating the visual indicator in response to detection of the occurrence of the event when the audible alarm is disabled.

12. The method of claim 1, further comprising providing a display monitor operatively coupled to the computer, and displaying a message on the display monitor in response to detection of the occurrence of the event when the audible alarm is disabled.

13. The method of claim 1, further comprising:

programming the backup power supply through the computer software to enable the audible alarm during at least a third predetermined time period in response to detection of the occurrence of the event; and programming the backup power supply through the computer software to disable the audible alarm during at least a fourth predetermined time period in response to detection of the occurrence of the event.

14. The method of claim 1, wherein the backup power supply includes an uninterruptible power supply.

15. A system for controlling an audible alarm on a backup power supply that indicates an occurrence of an event, the system comprising:

a backup power supply having an audible alarm; and a computing device operatively coupled to the backup power supply and to a main power supply, the computing device being configured to operate software installed thereon that is programmable to:

enable the audible alarm on the backup power supply during at least a first predetermined time period in response to detection of the occurrence of an event, and to disable the audible alarm on the backup power supply while the backup power supply is operational during at least a second predetermined time period in response to detection of the occurrence of an event.

16. The system of claim 15, wherein the event includes a condition of at least one of the computer, the backup power supply and the main power supply.

17. The system of claim 15, wherein the event includes the backup power supply providing power to the computer.

18. The system of claim 15, wherein the software is further programmable to designate at least one value that indicates, upon detection of the value, the occurrence of the event.

19. The system of claim 18, wherein the at least one value includes a user-definable value that can be modified using the programmable software.

20. The system of claim 15, wherein the software is further programmable to disable the audible alarm when the computing device is powered off.

21. The system of claim 15, wherein the software is further programmable to determine whether the computing device is in a low power state and to enable the audible alarm when the computing device enters a low power state.

22. The system of claim 15, wherein the software is further programmable to determine whether the computing device enters a low power state and to enable the audible alarm during the first and the second predetermined periods of time if the computing device is in a low power state.

23. The system of claim 15, wherein the backup power supply includes firmware through which the software of the computing device enables the audible alarm during one or more predetermined periods of time and disables the audible alarm during one or more predetermined periods of time.

24. The system of claim 15, wherein the backup power supply includes firmware through which the software of the computing device disables the audible alarm when at least one of the software is not operating and the computing device is powered off.

25. The system of claim 15, wherein the backup power supply includes firmware through which the software of the computing device enables the audible alarm when the computing device enters a low power state.

26. The system of claim 15, further comprising a visual indicator operatively coupled to one of the computing device and the backup power supply, the visual indicator configured to indicate the occurrence of the event when the audible alarm is disabled.

27. The system of claim 15, further comprising a display monitor operatively coupled to the computing device, the display monitor configured to display a message to indicate the occurrence of the event when the audible alarm is disabled.

28. The system of claim 15, wherein the backup power supply is operatively coupled to a computer network and configured to transmit an electronic message to one or more designated computing devices that indicates the occurrence of the event when the audible alarm is disabled.

29. The system of claim 15, wherein the backup power supply is operatively connected to a second computing device, the second computing device being configured to operate software installed thereon that is programmable to:

enable the audible alarm during at least a third predetermined time period in response to detection of the occurrence of the event, and to disable the audible alarm while the backup power supply is operational during at least a fourth predetermined time period in response to detection of the occurrence of the event.

30. The system of claim 15, wherein the backup power supply is an uninterruptible power supply.

* * * * *